US011752057B1

(12) United States Patent
Jahangiri

(10) Patent No.: US 11,752,057 B1
(45) Date of Patent: Sep. 12, 2023

(54) SPINAL SUPPORT DEVICE AND METHODS OF USE

(71) Applicant: CONTOUREAL, LLC, Portland, OR (US)

(72) Inventor: Parviz Jahangiri, Portland, OR (US)

(73) Assignee: Contoureal, LLC, Portland, OR (US)

( * ) Notice: Subject to any disclaimer, the term of this patent is extended or adjusted under 35 U.S.C. 154(b) by 0 days.

(21) Appl. No.: 18/097,132

(22) Filed: Jan. 13, 2023

(51) Int. Cl.
*A61H 1/00* (2006.01)
*A61H 15/00* (2006.01)

(52) U.S. Cl.
CPC ..... *A61H 1/008* (2013.01); *A61H 15/00* (2013.01); *A61H 2015/005* (2013.01); *A61H 2015/0071* (2013.01); *A61H 2201/164* (2013.01); *A61H 2201/1609* (2013.01); *A61H 2201/1623* (2013.01); *A61H 2201/1664* (2013.01); *A61H 2203/0456* (2013.01); *A61H 2205/081* (2013.01); *A61H 2230/825* (2013.01)

(58) Field of Classification Search
CPC .. A61H 1/0222; A61H 1/0292; A61G 7/1084; A61G 7/1086; A61G 7/1088; A61G 7/109; A61G 13/12; A61G 13/121; A61G 13/122; A61G 13/1225; A61G 13/123; A61G 13/1285; A61G 13/129; A61G 13/1295; A47C 7/402; A47C 7/46; A47C 7/462; A61F 5/022; A61F 5/026; A61F 5/048
USPC ..... 606/237; 601/115
See application file for complete search history.

(56) References Cited

U.S. PATENT DOCUMENTS

| | | | | |
|---|---|---|---|---|
| 2,283,549 | A | 5/1942 | Galbraith et al. | |
| 2,534,587 | A | 12/1950 | Fisher et al. | |
| 2,630,800 | A | 3/1953 | Voss et al. | |
| 4,230,099 | A | 10/1980 | Richardson | |
| 4,993,164 | A * | 2/1991 | Jacobsen | A47C 31/126 297/284.4 |
| 5,114,209 | A * | 5/1992 | Dunn | A47C 7/425 297/452.32 |
| 5,279,310 | A | 1/1994 | Hsien | |
| 5,613,254 | A | 3/1997 | Clayman et al. | |
| 5,774,916 | A | 7/1998 | Kurhi | |
| 5,820,573 | A * | 10/1998 | Ramos | A61H 7/001 606/240 |
| 6,921,372 | B2 * | 7/2005 | Shin | A61H 39/04 601/134 |

(Continued)

OTHER PUBLICATIONS

Ablespine, retrieved from https://ablespine.com/collections/ablespine/products/ablespine (Feb. 15, 2023) (1 page).

(Continued)

*Primary Examiner* — Adam Baker
(74) *Attorney, Agent, or Firm* — Baumgartner Patent Law; Marc Baumgartner

(57) ABSTRACT

Spinal support devices and methods of use. Support devices have a base unit, a neck support unit defining a first end, an upper thigh support unit defining a second end, and a mid-back support unit positioned between said neck and upper thigh support units, wherein the neck, upper thigh, and mid-back support units each have a convex shaped topside with an apex that is configured to align within designated concave shaped areas on the user's backside.

15 Claims, 8 Drawing Sheets

(56) References Cited

U.S. PATENT DOCUMENTS

| | | | | |
|---|---|---|---|---|
| 7,134,158 | B2 * | 11/2006 | Tokarz | A47C 20/027 5/733 |
| 8,100,846 | B1 * | 1/2012 | LaMonica | A61F 5/048 601/39 |
| 11,617,699 | B1 * | 4/2023 | Jahangiri | A61H 1/00 606/241 |
| 2011/0137343 | A1 | 6/2011 | Vitko | |

OTHER PUBLICATIONS

PosturePump®DiscHydrator® Instructions, 2021 (2 pages).
Spine-Worx Back Realignment Device, retrieved from https://spineworx.us/ (Feb. 15, 2023) (1 page).
Trigger Point Systems, retrieved from https://triggerpointsystems.com/products/trigger-point-rocker-buy-now?variant=42140232777940 (Feb. 15, 2023) (1 page).

* cited by examiner

SPINAL SUPPORT DEVICE AND METHODS OF USE

BACKGROUND OF THE INVENTION

Spinal pain and abnormal curvature are common and difficult problems for many people. These often result from significant and/or prolonged stress from the body simply supporting itself under normal conditions, physical exercise, or improper posture while sitting or standing.

Accordingly, there is a need in the art for a portable spinal support device designed for a particular user's anatomy and spinal issues that can help prevent or treat spinal malformities to either maintain or restore normal spinal curvature. People having significantly different anatomies or spinal misalignments should have access to different spinal support devices configured or otherwise customized to be used with their specific characteristics. Preferred spinal support devices should have the ability to both provide axial compressive load to the vertebrae to stimulate bone growth and induce corrective spinal curvature from the lordotic neck curvature to the sacral curvature while the user is in a supine position.

SUMMARY OF THE INVENTION

Preferred embodiments are directed to methods of using a spinal support device on a human: providing a spinal support device comprising a base unit having a longitudinal axis along first and second ends, and having a neck support unit defining the first end, a upper thigh support unit defining the second end, and a mid-back support unit positioned between said neck and upper thigh support units, wherein the neck, upper thigh, and mid-back support units each have a convex shaped topside with an apex; and positioning the person on the device in a supine position, wherein, the apex of the mid-back support unit supports the center, or within 0.5 inches up or down from said center, of the L1 vertebra, the apex of the neck support unit supports the center, or within 0.5 inches up or down from said center, of the C5 vertebra, and the apex of the upper thigh support unit supports the upper thighs.

Preferred methods include embodiments, wherein the neck support unit is configured to be slidable and releasably lockable along the longitudinal axis of the base unit both towards and away from the mid-back support unit so as to form a first gap between the neck support unit and the mid-back support unit; and wherein the upper thigh support unit is configured to be slidable and releasably lockable along the longitudinal axis of the base unit both towards and away from the mid-back support unit so as to form a second gap between the upper thigh support unit and the mid-back support unit Preferred methods include embodiments, further comprising measuring the length of a predetermined span of the human's spine and adjusting the neck and upper thigh support units either closer to or away from the mid-back support unit based on the measured length, wherein, for a first person having a longer measurement than a second person, the neck and upper thigh support units are moved away from the mid-back support unit for the first person and moved closer to the mid-back support unit for the second person.

Preferred methods include embodiments, wherein when the upper thigh support and the neck supports are moved away from the mid-back support and releasably locked, the second gap between the upper thigh support unit and the mid-back support unit is longer in length than the first gap between the neck support unit and the mid-back support unit.

Preferred methods include embodiments, wherein the length of the second gap is between 1.025 to 1.225 times greater than the length of the first gap.

Preferred methods include embodiments, wherein the length of the second gap is 1.125 times greater than the length of the first gap.

Preferred methods include embodiments, wherein intermittent locking points are set between: a) the neck support unit and mid-back support unit, and b) the upper thigh support unit and the mid-back support unit, such that the neck and upper thigh support units are releasably lockable at these points along the longitudinal axis and correspond to preset measured lengths of the predetermined span of the human's spine.

Preferred methods include embodiments, wherein the predetermined span of the human's spine that is measured is the distance between the top of the T1 vertebra to the bottom of the sacrum.

Preferred methods include embodiments, wherein the predetermined span is measured by having the user sit upright on a surface and measuring the distance between the T1 vertebra and the surface.

Preferred methods include embodiments, wherein when the predetermined length of the human spine is 23" or less, the neck and upper thigh support units are adjacent to the mid-back support such that no first or second gaps exists.

Preferred methods include embodiments, wherein when the length of the human spine is between 23" to 25", the first gap is between 0 to 1 inches and the second gap is between 1.025 to 1.225 times greater than the length of the first gap.

Preferred methods include embodiments, wherein when the length of the human spine is between 25" to 27", the first gap is between 1 to 2 inches and the second gap is between 1.025 to 1.225 times greater than the length of the first gap.

Preferred methods include embodiments, wherein when the length of the human spine is between 27" to 29", the first gap is between 2 to 3 inches and the second gap is between 1.025 to 1.225 times greater than the length of the first gap.

Preferred methods include embodiments, wherein when the length of the human spine is between 29" to 31", the first gap is between 3 to 4 inches and the second gap is between 1.025 to 1.225 times greater than the length of the first gap.

Preferred methods include embodiments, wherein when the length of the human spine is between 31" to 33", the first gap is between 4 to 5 inches and the second gap is between 1.025 to 1.225 times greater than the length of the first gap.

Preferred methods include embodiments, wherein the neck, upper thigh, and mid-back support units are not slidable along the longitudinal axis on the base, such that they are fixed in place.

Preferred methods include embodiments, further comprising measuring the length of a predetermined span of the human's spine and selecting the spinal support device from first and second spinal support devices, each having differently sized fixed distances between the mid-back support unit and the neck and upper thigh support unit, based on said measurement.

Preferred methods include embodiments, wherein the convex shaped topside of at least one of the support units comprises two parallel convex shaped topsides separated by a groove having a width.

Preferred methods include embodiments, wherein the two parallel convex shaped topsides can be moved closer to each other and farther away from each other thereby decreasing and enlarging the groove width respectively.

DETAILED DESCRIPTION OF THE INVENTION

Figure 1:
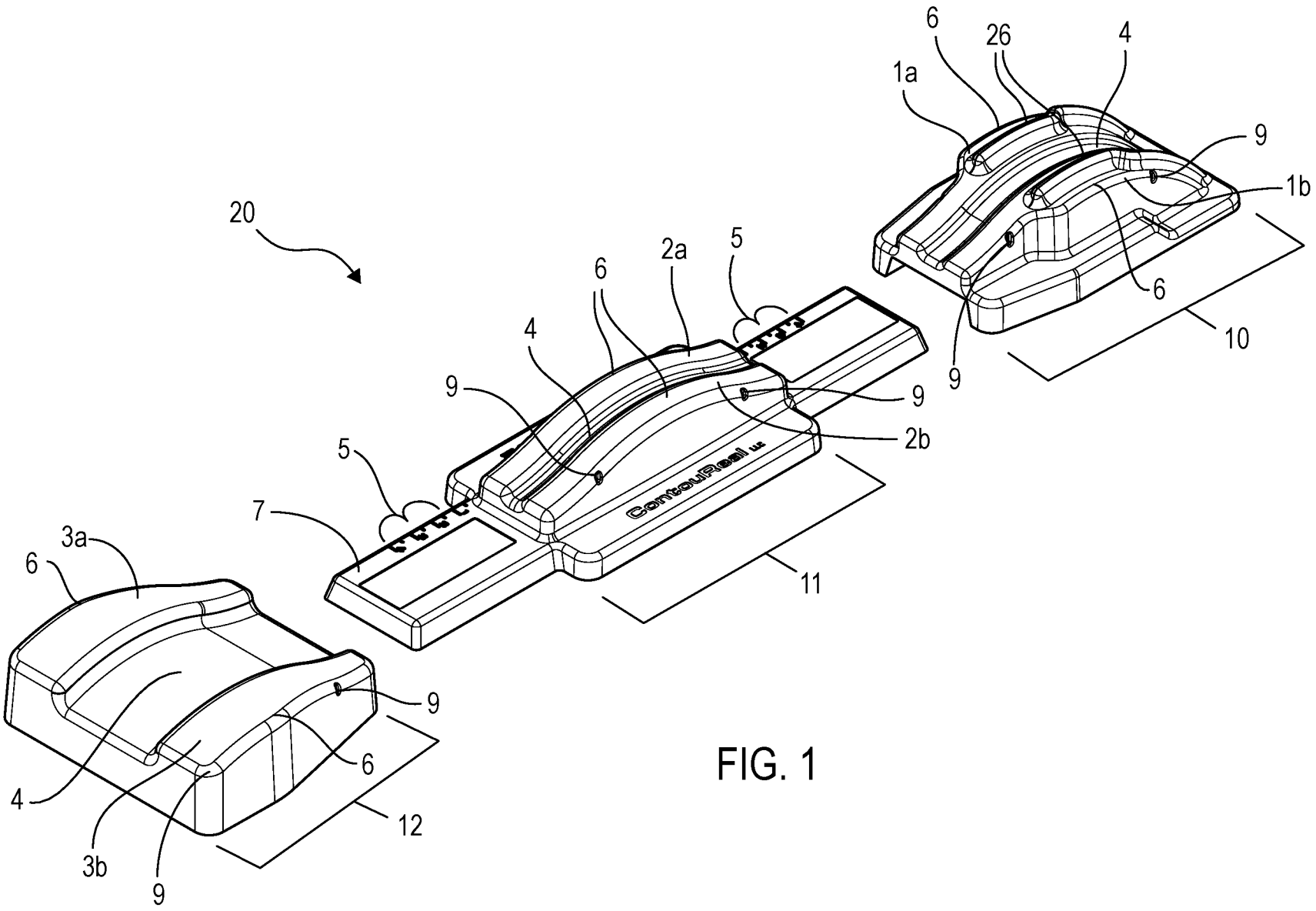
FIG. 1 is an exploded, perspective view of a spinal support device.
Figure 2:
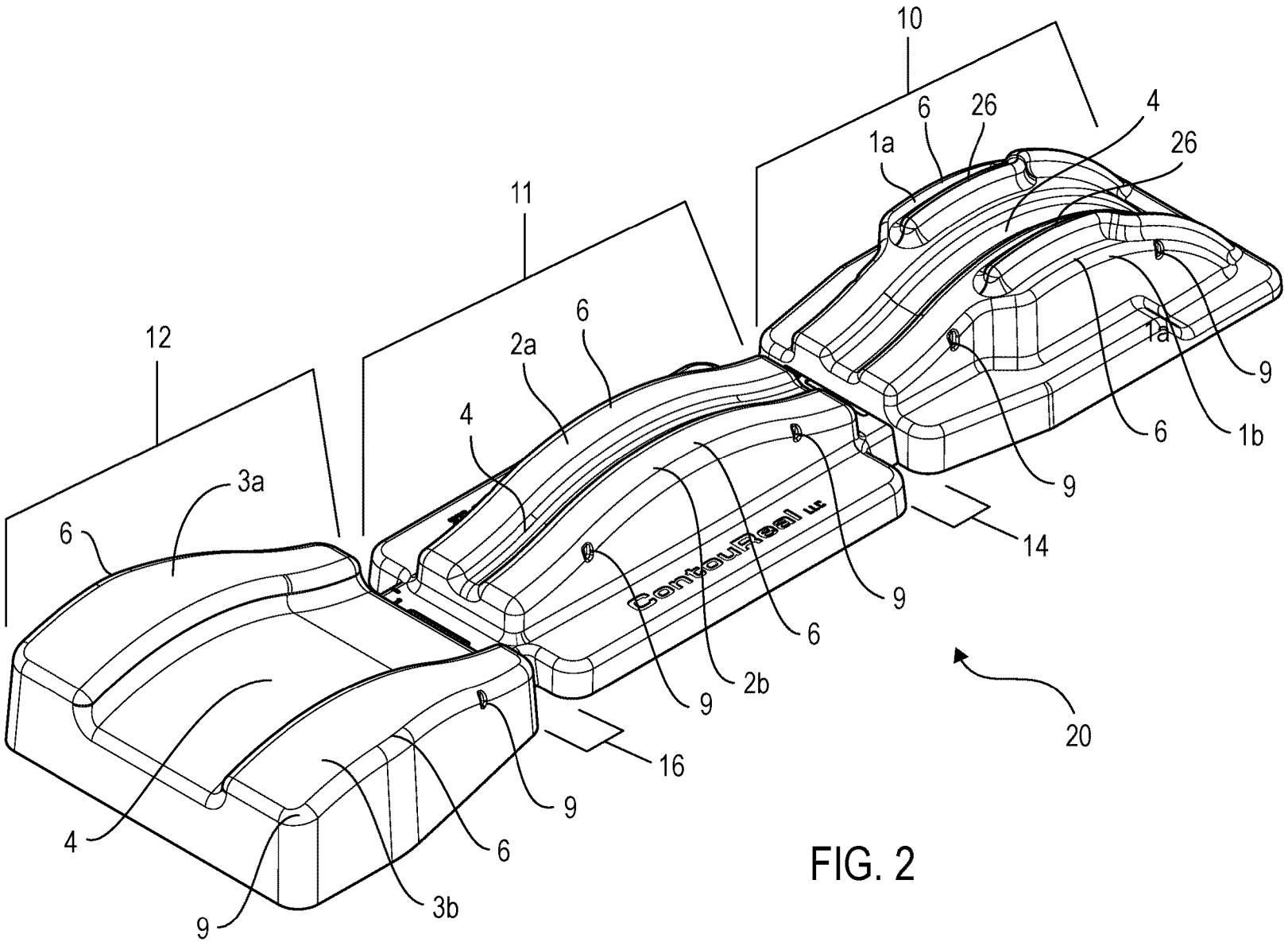
FIG. 2 is an assembled perspective view of a spinal support device.
Figure 3:
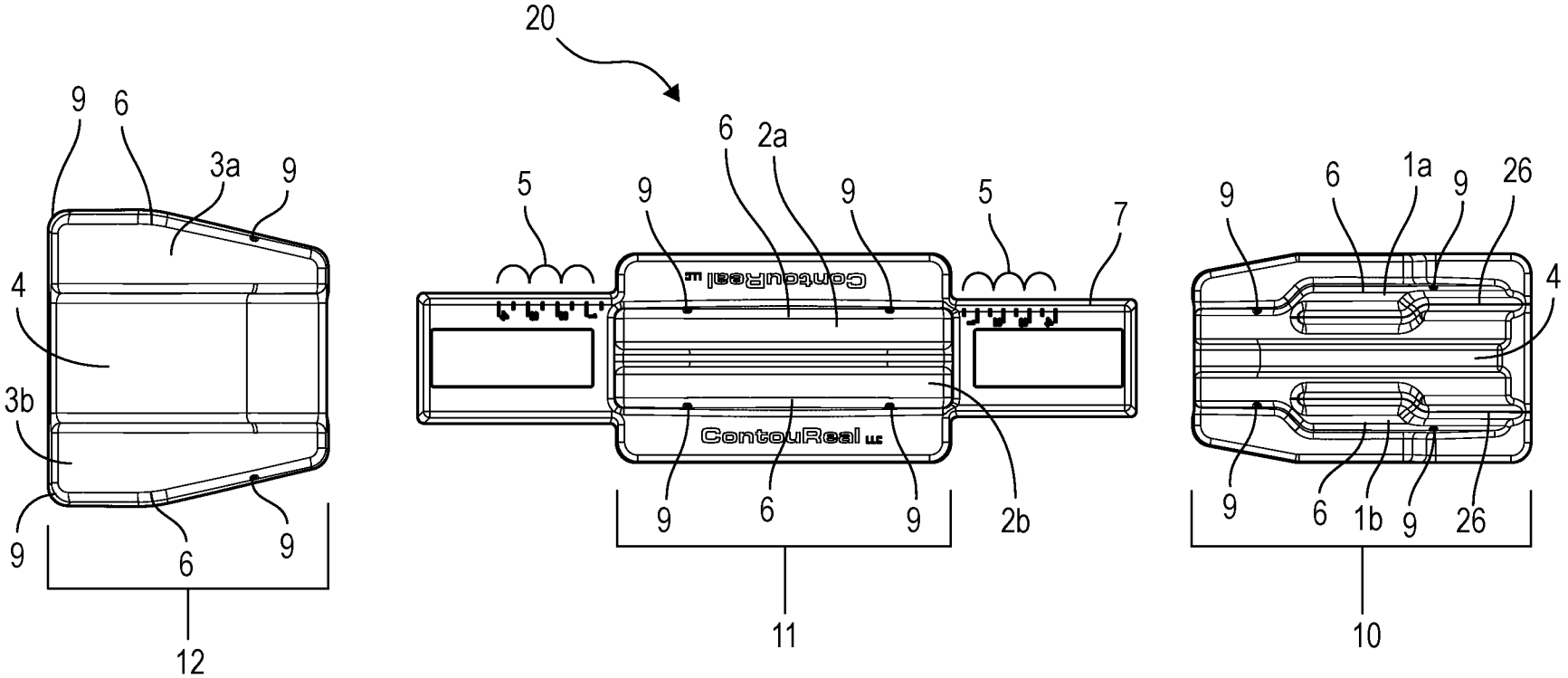
FIG. 3 is an exploded, topside view of a spinal support device.
Figure 4:
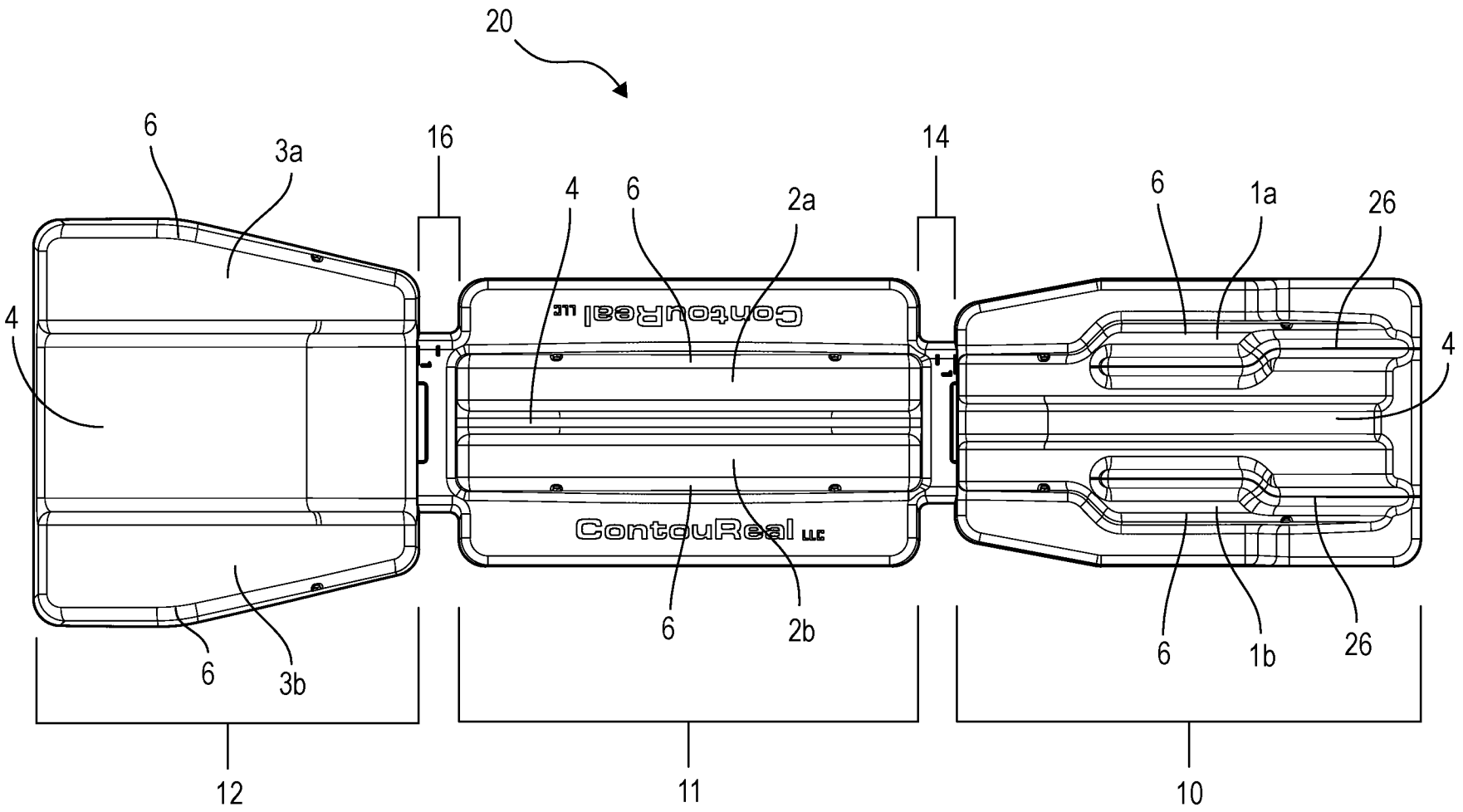
FIG. 4 is an assembled, topside view of a spinal support device.
Figure 5:
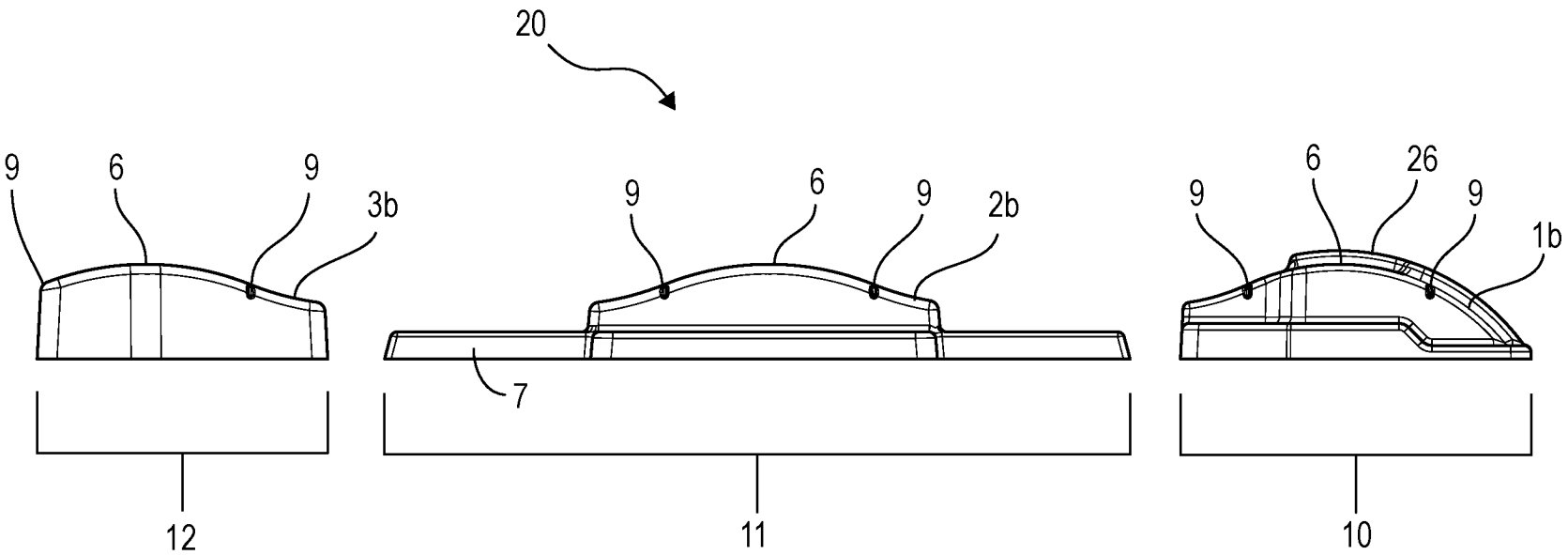
FIG. 5 is an exploded, left-side view of a spinal support device.
Figure 6:
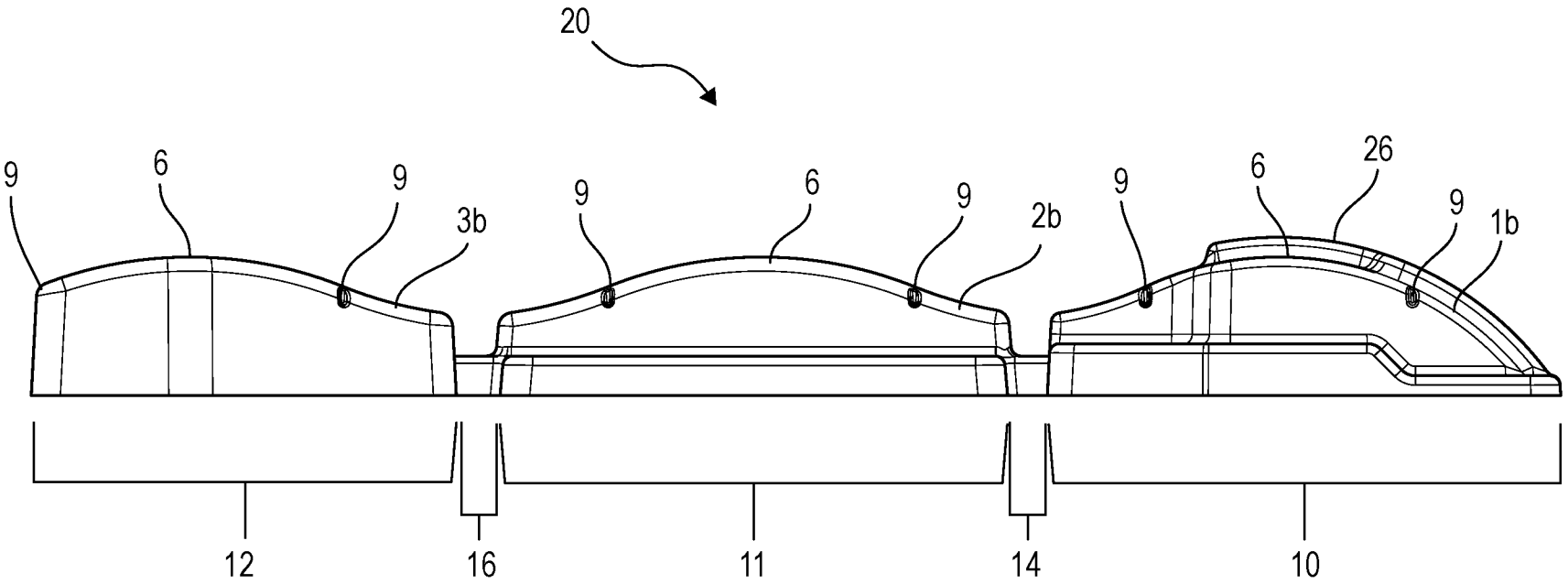
FIG. 6 is an assembled, left-side view of a spinal support device.

As shown in FIGS. 1-7, preferred spinal support devices 20 for methods of use described herein comprise a base unit 7 having a longitudinal axis along first and second ends, and three support units: a neck support unit (NSU) 10, a mid-back support unit (MBSU) 11 and an upper thigh support unit (UTSU) 12. Preferably the NSU 10 is positioned at the first end of the base 7, the UTSU 12 is positioned at the second, opposite end of the base 7, and the MBSU 11 is positioned between the NSU 10 and the UTSU 12, in the center of the base 7. While shown in FIGS. 2, 4, and 6 as terminating within the NSU 10 and the UTSU 12, according to non-preferred embodiments, the base 7 can extend past NSU 10 and UTSU 12. Regardless of its termination points, it is preferred that the UTSU 12 and the NSU 10 are the last support units on the base 7, such that there are no further support units positioned past them towards the first and second ends of the base 7 on the longitudinal axis. It is further preferred that there are only three support units (10, 11, 12) total on the base 7.

Preferably the base 7 is made of sturdy rigid, or semi-rigid material such as metal (e.g., steel, aluminum or alloy), hard plastic, polyurethane, or carbon, such that it can support the user, and act as a track for embodiments covering sliding NSU 10 and UTSU 12. The underside of the base 7 is preferably planar, but can also have support legs and/or caster wheels. According to certain embodiments, the legs can be adjustable to create customized heights of the device 20. According to further embodiments, the base 7 can be configured to lengthen or widen, such as through the utilization of a telescoping mechanism and/or extensions.

It is preferred that each of the support units (10, 11, 12) have a convex shaped topside with an apex 6. While the convex shaped topside can be a singular feature without a groove (not shown), it is preferred that each support unit (10, 11, 12) comprises two parallel convex shaped topsides separated by a groove 4 having a width and depth. For example, the NSU 10 and the MBSU 11 can have right and left convex shape topsides 1*a*/1*b* and 2*a*/2*b* respectively separated by groove 4 that is configured to accommodate the width and depth of a user's spine.

As different users have different spinal configurations and/or malformities, it is preferred that the right and left convex shape topsides 1*a*/1*b* and 2*a*/2*b* are configured be adjusted to either expand or decrease the width of the groove 4 to accommodate these differences. The depth of the groove 4 can also be adjustable if desired. The width of the groove can be increased and decreased utilizing any suitable mechanism, such as by decreasing and increasing the width of the right and left convex shape topsides 1*a*/1*b* and 2*a*/2*b*, respectively. Additionally, a telescoping mechanism, sliding track, and/or extensions can be used. Similarly, the height of the groove can be increased and decreased utilizing any suitable mechanism, such as by increasing and decreasing or the height of the right and left convex shape topsides 1*a*/1*b* and 2*a*/2*b*, respectively. Additionally, a telescoping mechanism, sliding track, and/or extensions can be used.

The right and left convex shape topsides 1*a*/1*b* and 2*a*/2*b* can be permanently fixed to the NSU 10 and the MBSU 11 respectively or can be detachable. According to certain embodiments, a plurality of different sized right and left convex shape topsides 1*a*/1*b* and 2*a*/2*b* can be provided and selected based on a particular patient's anatomy. Additionally, the right and left convex shape topsides 1*a*/1*b* and 2*a*/2*b* can be modular wherein layers can be added or removed to achieve different heights and widths, thereby defining different heights and widths of the groove 4. It is further preferred that the NSU 10 can include two parallel lateral supports 26 to prevent unwanted lateral motion of a user's neck. It is preferred that the lateral supports 26 are positioned to be on the outside of the user, such that they sandwich the neck when the user is lying on top of the device 20. Thus, while the lateral supports 26 may have a higher top than the convex shape topsides 1*a*/1*b*, the designated apex 6 of the NSU 10 is positioned on the convex shape topsides 1*a*/1*b* as shown in FIGS. 1-7. For the certain embodiments the apex 6 is the highest point on the support unit (10, 11, 12).

Additionally, the UTSU 12 can have right and left convex shape topsides 3*a*/3*b* separated by a groove 4 as well. As the UTSU 12 does not need to accommodate the user's spine, it is preferred that its groove is wider than the grooves 4 of the NSU 10 and the MBSU 11, such as over twice or over three times as wide.

It is preferred that each of the support units (10, 11, 12) is made of a rigid or semi-rigid material suitable for supporting the user in a supine position, such as plastic, wood, composite wood, metal, and foam. Additional flexible material, including foams, rubber, or other cushioning can be used for comfort. The entire support units (10, 11, 12) can be made of multiple materials or a singular material such as polyurethane.

Figure 7:
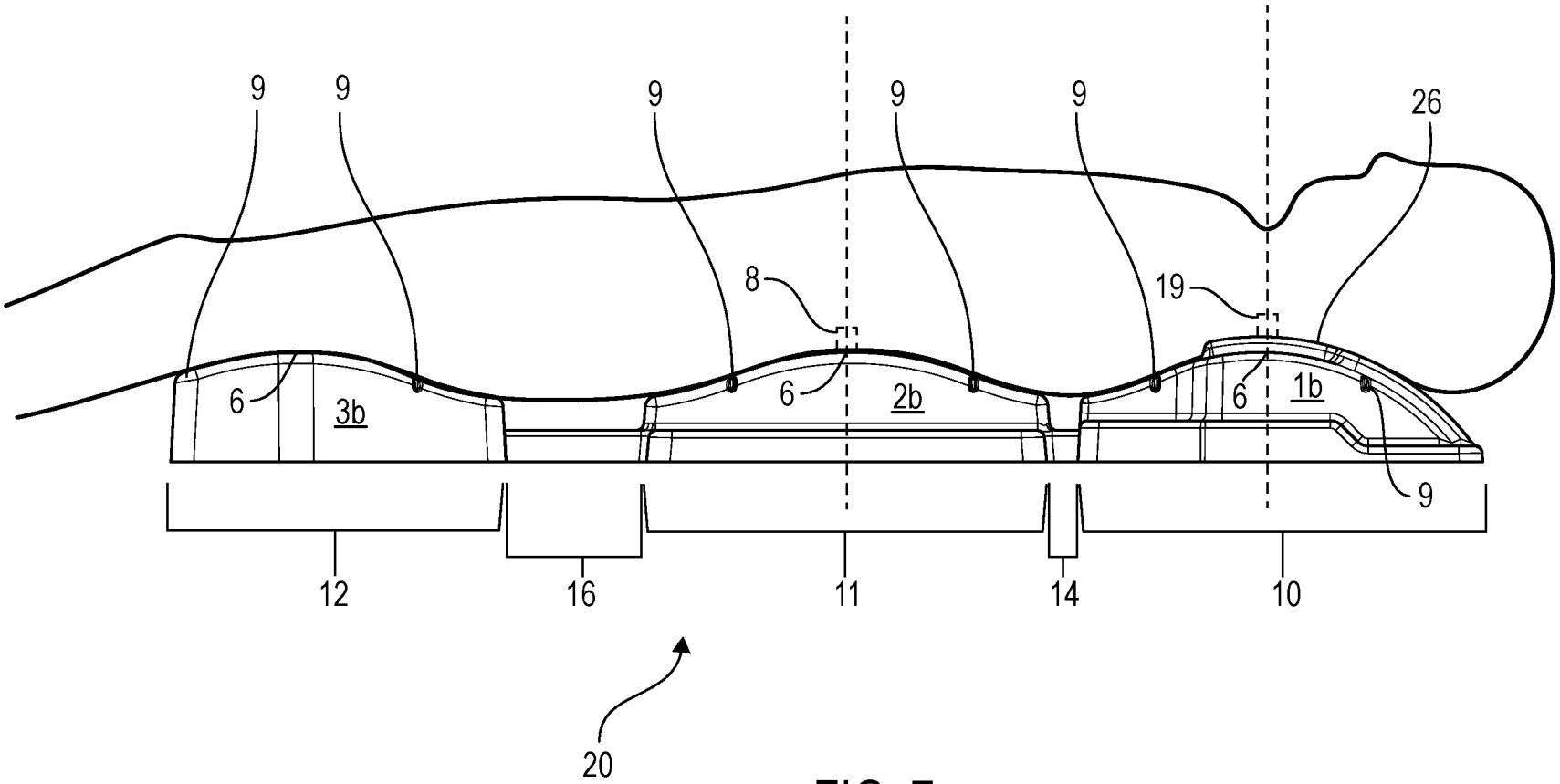
FIG. 7 is an assembled, left-side view of a spinal support device with a user in a supine position.
Figure 8:
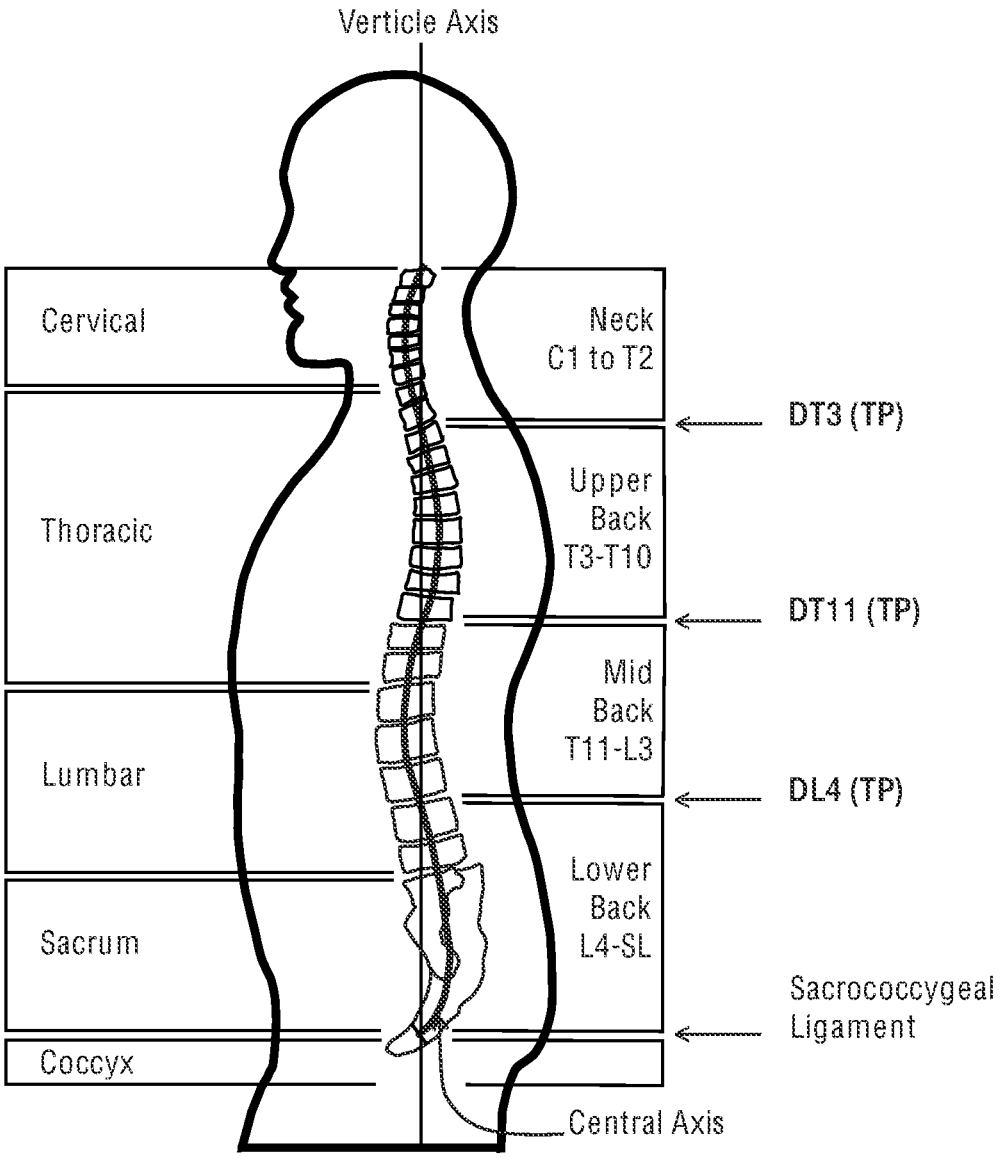
FIG. 8 is a drawing of a spine showing transitional points of curvature.

Transition points are points along the spinal column where spinal vertebrates changes in lining up from a concave shape to a convex shape. These transition points largely coincide with a vertical line (Verticle Axis), drawn between the top vertebrate to the tail bone, and a central line (Central Axis) that connects to the central axis of each vertebrate. Preferably these transition points should ideally be supported or controlled so that they relatively align in a straight line. Transitions points also coincide with traverse features on the body such as the nose, the sternomanubrial joint, the xiphisternal joint, the navel, and the hip joints respectively. FIG. 8 shows a human spine with the following transition points: DT3, DT11, DL4 and the sacrococcygeal ligament. In general, and as shown in FIG. 7, normal humans comprise three concave sections on their backside (the neck, mid-back, and the thighs) that the three support units (10, 11, 12) are configured to support and align with their convex shaped topsides 1*a*/1*b*, 2*a*/2*b*, and 3*a*/3*b*. It is preferred that the inflection points 9 on the support units (10, 11, 12) vertically align with their respective transition points on the spine, when the user is on the device 10 in a supine position. As used herein the term convex and concave can signify a curve, including the arc of a circle, oval, ellipse.

Preferred support units (10, 11, 12) comprise two inflection points 9 that are equidistant from a center apex 6 of each the convex shaped topsides 1*a*/1*b*, 2*a*/2*b*, and 3*a*/3*b*. By aligning the center apexes 6 of the support units (10, 11, 12), to their respective center of the spine's concave section being supported, the convex shaped topsides 1*a*/1*b*, 2*a*/2*b*, and 3*a*/3*b* automatically conform to the user's spine. Preferably, each inflection point 9 on each support unit (10, 11, 12), can change distance, symmetrically, based on the user's spinal size and shape, keeping the center apex 6 of each support unit (10, 11, 12) aligned with the user's respective centers of their three concave sections.

As shown in FIG. 7, when a human user is positioned on the device 20 in a supine position, the MBSU 11 generally supports the spine between the T11 and L3 vertebrae, with the apex 6 of the MBSU 11 supporting the center, or within 0.5 inches up or down from said center, of the L1 vertebrae 8. Similarly, the NSU 10 generally support the spine between the C1 and T2 vertebrae, with the apex 6 of the NSU 10 supporting the center, or within 0.5 inches up or down from said center, of the C5 vertebra 19. Finally, the UTSU 12 generally supports the body between the Sacrococcygeal ligament (SL) and up to the knee joint, with the apex 6 of the UTSU 12 supporting the center, or within 4 inches up or down of said center of the concave section of the back of the thighs, below the glutes. When aligned properly, the SL will align with the inflection point 9 on the UTSU 12 closest to the center. Adjustments can be made for larger spines where the SL sits lower on the inflection point 9 and for smaller spines where the SL sits higher on the inflection point 9.

The spinal support devices 20 and methods of use described herein can be used to prevent or treat spinal misalignments by maintaining or helping restore normal curvature in the spine. According to preferred embodiments, the spinal support devices 20 described herein can accommodate different users having different anatomies, non-exclusively including different spinal curvatures, spinal malformities such as kyphosis, lordosis, scoliosis, different lengths of spine, and different transition points within the spine.

Accommodating individualized users having separate anatomies from each other can be accomplished by the following three preferred embodiments, for example.

The first embodiment of accommodating individualized users having different anatomies is to provide a single adjustable device 20 that can be used with each of them. According to this method, the NSU 10 and/or the UTSU 12 are configured to be movable such as to be positioned and releasably locked closer to or further away from the MBSU 11. The MBSU 11 is preferably fixed in place in the center of the longitudinal axis of the base 7, but can also be configured to be movable and releasably locked along the base 7. As described in more detail below, the NSU 10 and the UTSU 12 are preferably configured to slide along the longitudinal axis of the base 7 which thus acts as a track. Preferably, the NSU 10 and the UTSU 12 have a recessed section on their underside with lips/tabs to prevent their lateral dislodgement from the base 7. Alternatively, the NSU 10 and the UTSU 12 can utilize a hollowed channel within to remain on the base 7 and prevent their lateral dislodgement therefrom. According to non-preferred embodiments not shown, the NSU 10 and the UTSU 12 can be moved towards and away from the MBSU 11 using a telescoping mechanism and/or extensions.

As shown in FIGS. 1-7, as the NSU 10 moves farther away along the base 7 from the MBSU 11, the gap 14 between the MBSU 11 and the NSU 10 increases in length. Conversely, as the NSU 10 moves closer along the base 7 towards the MBSU 11, the gap 14 between the MBSU 11 and the NSU 10 decreases in length. Similarly, as the UTSU 12 moves farther away along the base 7 from the MBSU 11, the gap 16 between the UTSU 12 and the MBSU 11 increases in length. Conversely, as the UTSU 12 moves closer along the base 7 towards the MBSU 11, the gap 16 between the MBSU 11 and the UTSU 12 decreases in length.

One preferred embodiment involves the use of intermittent locking points 5 that are set on the track 7 between the MBSU 11 and the NSU 10 and also between the MBSU 11 and the UTSU 12, such that the movable UTSU 12 and the NSU 10 are releasably lockable at these points 5 along the longitudinal axis. Preferably, and as discussed in detail below, these locking points 5 correspond to preset measured lengths of a predetermined span of the human's spine. Alternatively, and not shown, the movable UTSU 12 and the NSU 10 can be releasably locked continuously along the longitudinal axis of the track 7 without designated intermittent locking points. Regardless of whether intermittent or continuous releasable locking is utilized, any feasible releasable locking mechanisms can be used, including tabs, recesses, springs, clamps, and the like. Additional features that could optionally be adjustable non-exclusively include the width or depth of the groove 4 on the support units (10, 11, 12) and the height of the apex 6 of the support units (10, 11, 12), and the distance between inflection points 9 on the convex shape topsides 1*a*/1*b*, 2*a*/2*b*, and 3*a*/3*b*. Alternatively, a non-preferred embodiment would be where only one support unit selected from the NSU 10 or the UTSU 12 is adjustable along the track 7, and the other is in a fixed position.

The second embodiment of accommodating individualized users is to provide a plurality of different sized, yet adjustable devices 20. Under this non-preferred embodiment, one or more of the NSU 10 and the UTSU 12 can be slidable along the longitudinal axis on the base 7, such that they are not fixed in place. The plurality of different sized adjustable devices 20 can include a variety of adjustable or non-adjustable differences between them, non-exclusively including overall length of device 20, length of the track 7, the length of the gap (14 and 16) between the MBSU 11 and the NSU 10 and between the MBSU 11 and the UTSU 12, the width or depth of the groove 4 on the support units (10, 11, 12), the height of the apex 6 of the support units (10, 11, 12), and the distance between inflection points 9 on the convex shape topsides 1*a*/1*b*, 2*a*/2*b*, and 3*a*/3*b*. When practicing this second embodiment of accommodation, it is advantageous to make one or more measurements on the human, non-exclusively including a length of a predetermined span of the human's spine, overall height, and/or curvature types, and then select a particularly sized spinal support device from the plurality of differently sized yet adjustable spinal support devices, that corresponds to said one or more measurements.

The third embodiment of accommodating individualized users is to provide a plurality of different sized non-adjustable devices 20. Under this non-preferred embodiment, the support units (10, 11, 12) are not slidable along the longitudinal axis on the base 7, such that they are fixed in place. The plurality of different sized non-adjustable devices 20 can include a variety of differences between them, non-exclusively including overall length of device 20, length of the track 7, the length of the gap (14 and 16) between the MBSU 11 and the NSU 10 and between the MBSU 11 and the UTSU 12, the width or depth of the groove 4 on the support units (10, 11, 12), the height of the apex 6 of the support units (10, 11, 12), and the distance between inflection points 9 on the convex shape topsides 1*a*/1*b*, 2*a*/2*b*, and 3*a*/3*b*. When practicing this third embodiment of accommodation, it is advantageous to make one or more measurements on the human, non-exclusively including a length of a predetermined span of the human's spine, overall height, and/or curvature, and then select a particularly sized spinal support device from the plurality of differently sized spinal support devices, that corresponds to said one or more measurements.

According to the first and second methods of adjustable accommodation described above, preferred methods involve measuring the length of a predetermined span of the human's spine and then adjusting the NSU 10 and/or the UTSU 12 either closer to or away from the MBSU 11 based on this measured length. As an example, for a first person having a significantly longer measurement than a second person, the NSU 10 and/or the UTSU 12 are moved away from the MBSU 11 and releasably locked, thereby increasing the distance of gaps 14 and 16 for the first person and moved closer to the MBSU 11 and releasably locked for the second person thereby decreasing the distance of the gaps 14 and 16. For the embodiments of measuring the length of a predetermined span of the human's spine, adjustments can be made for various conditions, non-exclusively including those suffering from abnormal spinal curvatures, abnormal disc sizes, and temporal conditions such as when they woke up from sleep, based on the degree of offset of said characteristic. For example, if a normal curvature span measurement of 27 inches corresponds to a particular configuration of the support units (10, 11, and 12), a person suffering from lordosis or kyphosis having a 30 inch measurement might utilize the same configuration of support units (10, 11, and 12) if there is a 3 inch offset.

According to preferred embodiments, when the UTSU 12 and the NSU 10 are moved away from the MBSU 11 and releasably locked, the second gap 16 between the UTSU 12 and the MBSU 11 is longer in length than the first gap 14 between the NSU 10 and the MBSU 11. According to non-exclusive embodiments, the length of the second gap 16 is between 1.025 to 1.225 times greater than the length of the first gap 14, including 1.125 times greater than the length of the first gap 14.

The following is a preferred, yet non-exclusive method, of measuring a particular person and then adjusting the spinal support device 20 based on said measurement. The predetermined span of the human's spine that is measured can be the distance between the top of the T1 vertebra to the bottom of the sacrum. This span can be measured in any suitable way, including when the user is standing up, however can easily be done by having the user sit upright on a surface, such as the floor, mat, chair, or stool, and then measuring the distance between the top of the T1 vertebra and the surface (e.g., the floor, the mat, the seat of the chair, or seat of the stool).

Table 1 below lists a column of distances in inches based on the height from the top of the T1 vertebra to the bottom of the sacrum ("Height from T1 to bottom of sacrum"). As this length goes up from 23 to 33 inches by 0.5 inch increments, the gaps 14/16 can increase by the amount shown in the corresponding columns labeled "Gap 1" 14 and "Gap 2" 16, respectively. For example, when the height from the top of the T1 vertebra to the bottom of the sacrum is 23" or less, the NSU 10 and the UTSU 12 are adjacent to the MBSU 11 such that no first or second gap 14/16 exists. It is generally preferred that when the height from the top of the T1 vertebra to the bottom of the sacrum is between 23 to 25 inches, the first gap 14 is between 0 to 1 inches and the second gap 16 is between 1.025 to 1.225 times greater than the length of the first gap 14, including 0" if the first gap 14 does not exist at 0 inches. It is generally preferred that when the height from the top of the T1 vertebra to the bottom of the sacrum is between 25 to 27 inches, the first gap 14 is between 1 to 2 inches and the second gap 16 is between 1.025 to 1.225 times greater than the length of the first gap 14. Similarly, it is preferred that when the height from the top of the T1 vertebra to the bottom of the sacrum is between 27 to 29 inches, the first gap 14 is between 2 to 3 inches and the second gap 16 is between 1.025 to 1.225 times greater than the length of the first gap 14. It is further preferred that when the height from the top of the T1 vertebra to the bottom of the sacrum is between 29 to 31 inches, the first gap 14 is between 3 to 4 inches and the second gap 16 is between 1.025 to 1.225 times greater than the length of the first gap 14. Further it is preferred that when the height from the top of the T1 vertebra to the bottom of the sacrum is between 31" to 33", the first gap 14 is between 4 to 5 inches and the second gap 16 is between 1.025 to 1.225 times greater than the length of the first gap 14.

The values provided in Table 1 are merely preferred values and similar measurements can be used to achieve similar configurations or ratios between values. Devices 20 accommodating people having smaller or larger spans from the top of the T1 vertebra to the bottom of the sacrum are also readily included herein. For example, devices for children, having this span under 23", such as between 16"-23", and for tall people having this span over 33", such as 33-38", are also envisioned herein. According to preferred embodiments, the devices 20 herein are configured to only be used for adults or those having a height measured from the top of the T1 vertebra to the bottom of the sacrum at 23" or higher. Devices configured for users with this span under 23" and over 33" can have adjustable gaps with distances and/or ratios similar to those disclosed in Table 1.

In addition to measuring the span from top of the T1 vertebra to the bottom of the sacrum, other spans are readily envisioned herein including the bottom of the C7 vertebra, the bottom of the T1 vertebra, or the top/bottom of the T2 vertebra to the bottom or top of the sacrum, for example. The difference between the top T1 vertebra and another upper marker position (e.g., bottom of the C7 vertebra, the bottom of the T1 vertebra or top/bottom of T2 vertebra) can readily be determined and the values in Table 1 can be adjusted accordingly. Likewise, the difference between the bottom of the sacrum and another lower marker position (e.g., top of sacrum) can readily be determined and the values in Table 1 can be adjusted accordingly. For example, if the upper marker position is 0.25 inches above the top of the T1 vertebra (e.g., the bottom of the C7 vertebra) and the lower marker position is 0.25 inches below the bottom of the sacrum, the values of the height column in Table 1 could be increased by 0.5 inch for each row, while the remaining values in the other columns would remain the same. Similarly, if the upper marker position is 0.25 inches above the top of the T1 vertebra (e.g, the bottom of the C7 vertebra) and the lower marker position is 0.25 inches above the bottom of the sacrum, the height column in Table 1 would remain the same, as would the remaining values in the other columns.

When using intermittent locking points 5, each point preferably corresponds to a predetermined setting (e.g., first column of Table 1), which in turn corresponds to distances in the gaps 14/16 (and ratios between the gaps) and the measurement of a designated span on the user. According to preferred embodiments, the device 20 non-exclusively includes 21 locking points, or 1-10, or 1-15, or 1-20, or 1-25 locking points. While Table 1 increases in .5 inch increments, devices increasing in other increments, e.g., 1 inch, 1.5 inch, or .25 inch increments are also envisioned herein. The Table 1 values can readily be calculated and adjusted according to these different increments. For example, if 1 inch increments are used in the "Height" column instead of 0.5 inches as currently shown, only every other row of values can be used, and the "Settings" column only increases by 0.5 inch.

For the third embodiment of accommodating individualized users by providing a plurality of different sized non-adjustable devices 20, where the support units (10, 11, 12) are not slidable along the longitudinal axis on the base 7, the chart can be used to select one of a plurality of spinal support devices 20. For example, two or more fixed devices 20 can be created for two or more of the 21 rows (or other dimensions and gaps) and the user's device can be selected from these two or more devices based on the measurement of the designated spinal span, such as the top of the T1 vertebra to the bottom of the sacrum. All variations described above for adjustable devices can be utilized with the plurality of fixed devices, including different spinal spans for measurements, spinal spans the top of the T1 vertebra to the bottom of the sacrum that are shorter than 23" and longer than 33", and the ratios between the first and second gaps 14/16.

According to additional embodiments (not shown) motorized massage balls can be made to travel on a contoured fixed or guided track that follows the convex body curves. Optionally, massage balls can be positioned within tracks on the convex shape topsides 1*a*/1*b* and/or 2*a*/2*b* where they can roll on the tracks like ball bearings to increase blood flow. Further embodiments, not shown, can include a vibrating motor incorporated into the device 20 to improve blood circulation or loosen muscles, whether coupled with one or more of the support units (10, 11, 12) and/or the base 7. Further preferred embodiments include coupling exercise equipment to the device 20. Non-exclusive options include ropes, rubber or elastic bands, bars, cages, and devices that can press the person against the device 20, or allow them to lift weights, or perform strengthening or stretching movements.

Preferred methods involve a user taking a measurement of a predetermined span of the human's spine that corresponded to predetermined configurations in a spinal support device 20. The spinal device 20 is adjusted or otherwise selected accordingly and optionally further adjusted based on additional measurements or user characteristics such as abnormal curvatures, abnormal discs, current time of day, etc. The user can then lie on their customized device 20 for any suitable period of time, such as between 5 and 60 minutes while the apexes 6 of the support units (10, 11, 12) align with the centers of the three concave sections of the user's backside. The user can remain still lying on the device, or move such as to perform strengthening or stretching exercises. According to preferred methods of use, a separate support, detached from the devices 20 provided herein, can be used to support the concave section of a the backside of a user's ankles. This could be a cylindrical device, such as a roller, wherein the convex form of the roller aligns with the concave section of the user.

TABLE 1

| Setting | First Gap (inches) | Second Gap (inches) | Height from T1 to bottom of sacrum (inches) |
|---|---|---|---|
| 0 | 0 | 0 | 23 |
| .25 | .25 | .28 | 23.5 |
| .5 | .5 | .625 | 24 |
| .75 | .75 | .84 | 24.5 |
| 1 | 1 | 1.125 | 25 |
| 1.25 | 1.25 | 1.4 | 25.5 |
| 1.5 | 1.5 | 1.875 | 26 |
| 1.75 | 1.75 | 1.97 | 26.5 |
| 2 | 2 | 2.25 | 27 |
| 2.25 | 2.25 | 2.53 | 27.5 |
| 2.5 | 2.5 | 2.8 | 28 |
| 2.75 | 2.75 | 3.1 | 28.5 |
| 3 | 3 | 3.375 | 29 |
| 3.25 | 3.25 | 3.65 | 29.5 |
| 3.5 | 3.5 | 3.93 | 30 |
| 3.75 | 3.75 | 4.21 | 30.5 |
| 4 | 4 | 4.5 | 31 |
| 4.25 | 4.25 | 4.78 | 31.5 |
| 4.5 | 4.5 | 5.06 | 32 |
| 4.75 | 4.75 | 5.34 | 32.5 |
| 5 | 5 | 5.625 | 33 |

The invention claimed is:

1. A method of using a spinal support device on a human:

providing a spinal support device comprising a base unit having a longitudinal axis along first and second ends, and having a neck support unit defining the first end, an upper thigh support unit defining the second end, and a mid-back support unit positioned between said neck and upper thigh support units, wherein the neck, upper thigh, and mid-back support units each have a convex shaped topside with an apex; and positioning the person on the device in a supine position, wherein, the apex of the mid-back support unit supports the center, or within 0.5 inches up or down from said center, of the L1 vertebra, the apex of the neck support unit supports the center, or within 0.5 inches up or down from said center, of the C5 vertebra, and the apex of the upper thigh support unit supports the upper thighs, wherein the neck support unit is configured to be slidable and releasably lockable along the longitudinal axis of the base unit both towards and away from the mid-back support unit so as to form a first gap between the neck support unit and the mid-back support unit; and wherein the upper thigh support unit is configured to be slidable and releasably lockable along the longitudinal axis of the base unit both towards and away from the mid-back support unit so as to form a second gap between the upper thigh support unit and the mid-back support unit;

measuring a predetermined span of the human's spine that is the distance between the top of the T1 vertebra to the bottom of the sacrum and adjusting the neck and upper thigh support units either closer to or away from the mid-back support unit based on the measured length, wherein, for a first person having a longer measurement than a second person, the neck and upper thigh support units are moved away from the mid-back support unit for the first person and moved closer to the mid-back support unit for the second person and when the predetermined length of the human spine is 23" or less, the neck and upper thigh support units are adjacent to the mid-back support such that no first or second gaps exists; and wherein intermittent locking points are set between: a) the neck support unit and mid-back support unit, and b) the upper thigh support unit and the mid-back support unit, such that the neck and upper thigh support units are releasably lockable at these points along the longitudinal axis and correspond to preset measured lengths of the predetermined span of the human's spine.

2. The method of claim 1, wherein when the length of the human spine is between 23" to 25", the first gap is between 0 to 1 inches and the second gap is between 1.025 to 1.225 times greater than the length of the first gap.

3. The method of claim 2, wherein when the length of the human spine is between 25" to 27", the first gap is between 1 to 2 inches and the second gap is between 1.025 to 1.225 times greater than the length of the first gap.

4. The method of claim 3, wherein when the length of the human spine is between 27" to 29", the first gap is between 2 to 3 inches and the second gap is between 1.025 to 1.225 times greater than the length of the first gap.

5. The method of claim 4, wherein when the length of the human spine is between 29" to 31", the first gap is between 3 to 4 inches and the second gap is between 1.025 to 1.225 times greater than the length of the first gap.

6. The method of claim 5, wherein when the length of the human spine is between 31" to 33", the first gap is between 4 to 5 inches and the second gap is between 1.025 to 1.225 times greater than the length of the first gap.

7. A method of using a spinal support device on a human:

providing a spinal support device comprising a base unit having a longitudinal axis along first and second ends, and having a neck support unit defining the first end, an upper thigh support unit defining the second end, and a mid-back support unit positioned between said neck and upper thigh support units, wherein the neck, upper thigh, and mid-back support units each have a convex shaped topside with an apex; and positioning the person on the device in a supine position, wherein, the apex of the mid-back support unit supports the center, or within 0.5 inches up or down from said center, of the L1 vertebra, the apex of the neck support unit supports the center, or within 0.5 inches up or down from said center, of the C5 vertebra, and the apex of the upper thigh support unit supports the upper thighs, wherein the neck support unit is configured to be slidable and releasably lockable along the longitudinal axis of the base unit both towards and away from the mid-back support unit so as to form a first gap between the neck support unit and the mid-back support unit; and wherein the upper thigh support unit is configured to be slidable and releasably lockable along the longitudinal axis of the base unit both towards and away from the mid-back support unit so as to form a second gap between the upper thigh support unit and the mid-back support unit;

measuring a predetermined span of the human's spine that is the distance between the top of the T1 vertebra to the bottom of the sacrum and adjusting the neck and upper thigh support units either closer to or away from the mid-back support unit based on the measured length, wherein, for a first person having a longer measurement than a second person, the neck and upper thigh support units are moved away from the mid-back support unit for the first person and moved closer to the mid-back support unit for the second person and when the length of the human spine is between 23" to 25", the first gap is between 0 to 1 inches and the second gap is between 1.025 to 1.225 times greater than the length of the first gap; and wherein intermittent locking points are set between: a) the neck support unit and mid-back support unit, and b) the upper thigh support unit and the mid-back support unit, such that the neck and upper thigh support units are releasably lockable at these points along the longitudinal axis and correspond to preset measured lengths of the predetermined span of the human's spine.

8. The method of claim 7, wherein when the length of the human spine is between 25" to 27", the first gap is between 1 to 2 inches and the second gap is between 1.025 to 1.225 times greater than the length of the first gap.

9. The method of claim 8, wherein when the length of the human spine is between 27" to 29", the first gap is between 2 to 3 inches and the second gap is between 1.025 to 1.225 times greater than the length of the first gap.

10. The method of claim 9, wherein when the length of the human spine is between 29" to 31", the first gap is between 3 to 4 inches and the second gap is between 1.025 to 1.225 times greater than the length of the first gap.

11. The method of claim 10, wherein when the length of the human spine is between 31" to 33", the first gap is between 4 to 5 inches and the second gap is between 1.025 to 1.225 times greater than the length of the first gap.

12. A method of using a spinal support device on a human:

providing a spinal support device comprising a base unit having a longitudinal axis along first and second ends, and having a neck support unit defining the first end, an upper thigh support unit defining the second end, and a mid-back support unit positioned between said neck and upper thigh support units, wherein the neck, upper thigh, and mid-back support units each have a convex shaped topside with an apex; and positioning the person on the device in a supine position, wherein, the apex of the mid-back support unit supports the center, or within 0.5 inches up or down from said center, of the L1 vertebra, the apex of the neck support unit supports the center, or within 0.5 inches up or down from said center, of the C5 vertebra, and the apex of the upper thigh support unit supports the upper thighs, wherein the neck support unit is configured to be slidable and releasably lockable along the longitudinal axis of the base unit both towards and away from the mid-back support unit so as to form a first gap between the neck support unit and the mid-back support unit; and wherein the upper thigh support unit is configured to be slidable and releasably lockable along the longitudinal axis of the base unit both towards and away from the mid-back support unit so as to form a second gap between the upper thigh support unit and the mid-back support unit;

measuring a predetermined span of the human's spine that is the distance between the top of the T1 vertebra to the bottom of the sacrum and adjusting the neck and upper thigh support units either closer to or away from the mid-back support unit based on the measured length, wherein, for a first person having a longer measurement than a second person, the neck and upper thigh support units are moved away from the mid-back support unit for the first person and moved closer to the mid-back support unit for the second person and when the length of the human spine is between 25" to 27", the first gap is between 1 to 2 inches and the second gap is between 1.025 to 1.225 times greater than the length of the first gap; and wherein intermittent locking points are set between: a) the neck support unit and mid-back support unit, and b) the upper thigh support unit and the mid-back support unit, such that the neck and upper thigh support units are releasably lockable at these points along the longitudinal axis and correspond to preset measured lengths of the predetermined span of the human's spine.

13. The method of claim 12, wherein when the length of the human spine is between 27" to 29", the first gap is between 2 to 3 inches and the second gap is between 1.025 to 1.225 times greater than the length of the first gap.

14. The method of claim 13, wherein when the length of the human spine is between 29" to 31", the first gap is between 3 to 4 inches and the second gap is between 1.025 to 1.225 times greater than the length of the first gap.

15. The method of claim 14, wherein when the length of the human spine is between 31" to 33", the first gap is between 4 to 5 inches and the second gap is between 1.025 to 1.225 times greater than the length of the first gap.

* * * * *